US005642675A

United States Patent [19]

Webb

[11] Patent Number: 5,642,675

[45] Date of Patent: Jul. 1, 1997

[54] PROPPED KNOCKDOWN FURNITURE

[76] Inventor: William T. Webb, 1621 H St., Geneva, Nebr. 68361

[21] Appl. No.: 495,896

[22] Filed: Jun. 28, 1995

[51] Int. Cl.[6] ..... A47B 5/00

[52] U.S. Cl. ..... 108/48; 108/42

[58] Field of Search ..... 108/42, 47, 48, 108/193, 180, 153, 144; 211/187, 186, 88, 90, 87

[56] References Cited

U.S. PATENT DOCUMENTS

| | | | |
|---|---|---|---|
| 3,519,004 | 7/1970 | McKernan | 108/48 X |
| 3,596,942 | 8/1971 | Zoebelein | 108/180 X |
| 3,784,025 | 1/1974 | Dumit . | |
| 3,851,600 | 12/1974 | Kohl | 108/144 |
| 3,869,993 | 3/1975 | Edlund . | |
| 3,870,266 | 3/1975 | MacDonald . | |
| 3,976,015 | 8/1976 | McMurray | 108/48 X |
| 4,099,472 | 7/1978 | Kellogg . | |
| 4,145,849 | 3/1979 | Shindoll et al. | 108/47 X |
| 4,411,400 | 10/1983 | Everett | 108/47 X |
| 4,919,280 | 4/1990 | Phillips | 211/87 |
| 5,002,247 | 3/1991 | Dispenza et al. | 108/144 X |
| 5,080,311 | 1/1992 | Engstrom . | |
| 5,115,924 | 5/1992 | König . | |
| 5,221,013 | 6/1993 | Santucci . | |

*Primary Examiner*—José V. Chen

[57] ABSTRACT

Readily assembled and disassembled furniture supported by propping against a wall or other vertical environmental surface. The furniture has vertical legs located on its front side. Shelves or other horizontal members span the legs, and interfit with the legs at grooved joints. The grooves are horizontal, and the shelves slide into engagement with the legs from the rear. The shelves are notched to cooperate with the legs such that the front and side surfaces of a joined leg and shelf are flush. Knobs projecting downwardly from the shelves occupy dedicated grooves formed in the legs. The knobs prevent lateral horizontal displacement of the shelves, while eliminating the need for precision at the notched joints. Assembly is most readily performed with the legs lying on the floor, face down. After the shelves are slid into place, the assembled furniture is tilted into an upright orientation, and propped against the wall. The legs support the shelves vertically. Weight of the rear location of the shelves prevents toppling to the front, and abutment of the shelves with the wall prevents toppling to the rear. The resultant furniture has the appearance of furniture assembled solidly and precisely with fasteners and fittings, but is unencumbered by such hardware.

2 Claims, 3 Drawing Sheets

PROPPED KNOCKDOWN FURNITURE

BACKGROUND OF THE INVENTION

1. FIELD OF THE INVENTION

The present invention relates to furniture which is supported in a standing condition by propping the furniture against a wall. Legs are provided on one side of the furniture, and inclination which would otherwise allow the furniture to topple on the unsupported side is opposed by the wall. The furniture is assembled by interlocking component parts without the use of fasteners, adhesives, and the like.

2. DESCRIPTION OF THE PRIOR ART

Practicality of furniture and its assembly have been advancing over many years. One area of improvement of these aspects has been to minimize the number of parts and components. Another area of improvement, particularly with respect to assembly and disassembly, has been to eliminate the use of hand tools.

A specific area of focus of quickly erected and dismantled furniture, hereinafter referred to as knockdown furniture, has been that of shelving. An example of free standing shelving is provided in U.S. Pat. No. 4,099,472, issued to Harlan F. Kellogg on Jul. 11, 1978. Each shelf panel includes a section cut from each corner, similarly to the present invention. However, final assembly of Kellogg's furniture relies upon tightening vertical legs onto threaded studs formed integrally therein. In the present invention, no threaded fasteners are employed. Kellogg provides conventional leg layout including front and rear legs. By contrast, in the present invention, only the front of the furniture has legs contacting the floor.

U.S. Pat. No. 5,115,924, issued to Jochen König on May 26, 1992, describes a shelving system wherein vertical posts clamp to the shelves by threaded clamps. As in the case of Kellogg, König's invention has threaded members absent in the present invention. König's shelving is also conventional, having front and rear legs.

A shelf which is supported on lateral vertical surfaces is seen in U.S. Pat. No. 5,221,013, issued to Donald G. Santucci on Jun. 22, 1993. However, this invention locks in place by bearing resiliently upon surrounding vertical surfaces, and does not contact the floor or other horizontal surface. By contrast, the present invention has legs for supporting itself partially upon a floor. Also, the present invention does not rely upon expanding against two opposed surfaces.

A frequently employed peg and groove attachment scheme is seen in U.S. Pat. No. 3,784,025, issued to Joseph P. Dumit on Jan. 8, 1974. To both support weight above a floor and also to resist a moment, two pegs must engage respective grooves. By contrast, peg and groove interfitting is not employed to resist a moment in the present invention. Also, the assembled furniture of Dumit includes vertical support at front and rear. By contrast, all vertical support of the present invention occurs only at the front.

Furniture having a tabletop and a spaced apart, parallel shelf is shown in U.S. Pat. No. 3,869,993, issued to Walter W. Edlund on Mar. 11, 1975. The shelf is lowered onto the legs of the furniture, which have a step formed for stopping the shelf and maintaining it in place. By contrast, shelves of the present invention are slid laterally into engagement with the legs. Edlund also has front and rear legs, as opposed to the present invention, wherein there are only legs in the front.

None of the above inventions and patents, taken either singly or in combination, is seen to describe the instant invention as claimed.

SUMMARY OF THE INVENTION

The present invention enables rapid interfitting of shelves and legs by an uncomplicated peg and groove system. The shelves are notched to complement the vertical legs on which they rest. A knob or short peg projecting vertically from each shelf enters a groove formed in the leg, to resist lateral horizontal displacement.

The furniture employs a novel propping support to stand erect. Legs are located at one side only of the shelf assembly, which for purposes of discussion will be called the front. These legs can easily support the weight of the furniture in addition to any normal objects placed thereon. Therefore, the only remaining need is to resist progressive inclination and toppling of the furniture. This is provided by propping the rear of the furniture against a vertical surface, such as a building wall.

The interfitting scheme by which the horizontal members, which are shelves in most cases, attach to the vertical legs enables monolithic construction of the legs and nearly monolithic construction of shelves. Each shelf comprises a sheet of planar material, with a number of pegs or knobs adhered or inserted therein. This construction characteristic eliminates fasteners, metal parts such as anchors and plates having grooves formed therein, and like components which would otherwise be required for interfitting major components.

The resultant furniture is therefore inexpensively fabricated from primary materials, such as woods and melamine-formica sheet. Only uncomplicated routing and cutting procedures are required to form the grooves in the legs, and to provide the knobs on the shelves. The assembled furniture retains aesthetic qualities of the primary materials, in particular providing the aesthetically pleasing effect of the complementary interfit described above, while simultaneously being unencumbered by supplementary fittings and plates. Despite these aesthetic qualities and economies, the furniture is also readily assembled and disassembled.

Accordingly, it is a principal object of the invention to provide furniture which has vertical legs on only one side, and is propped at the other side.

It is another object of the invention to fit horizontal components of the furniture to vertical components by uncomplicated interlocking which does not require tools.

It is a further object of the invention to avoid reliance upon threaded fasteners, springs, and supplementary fittings, plates, and like components.

Still another object of the invention is to provide furniture wherein only the primary materials are visible.

Yet another object of the invention is to enable inexpensive fabrication.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
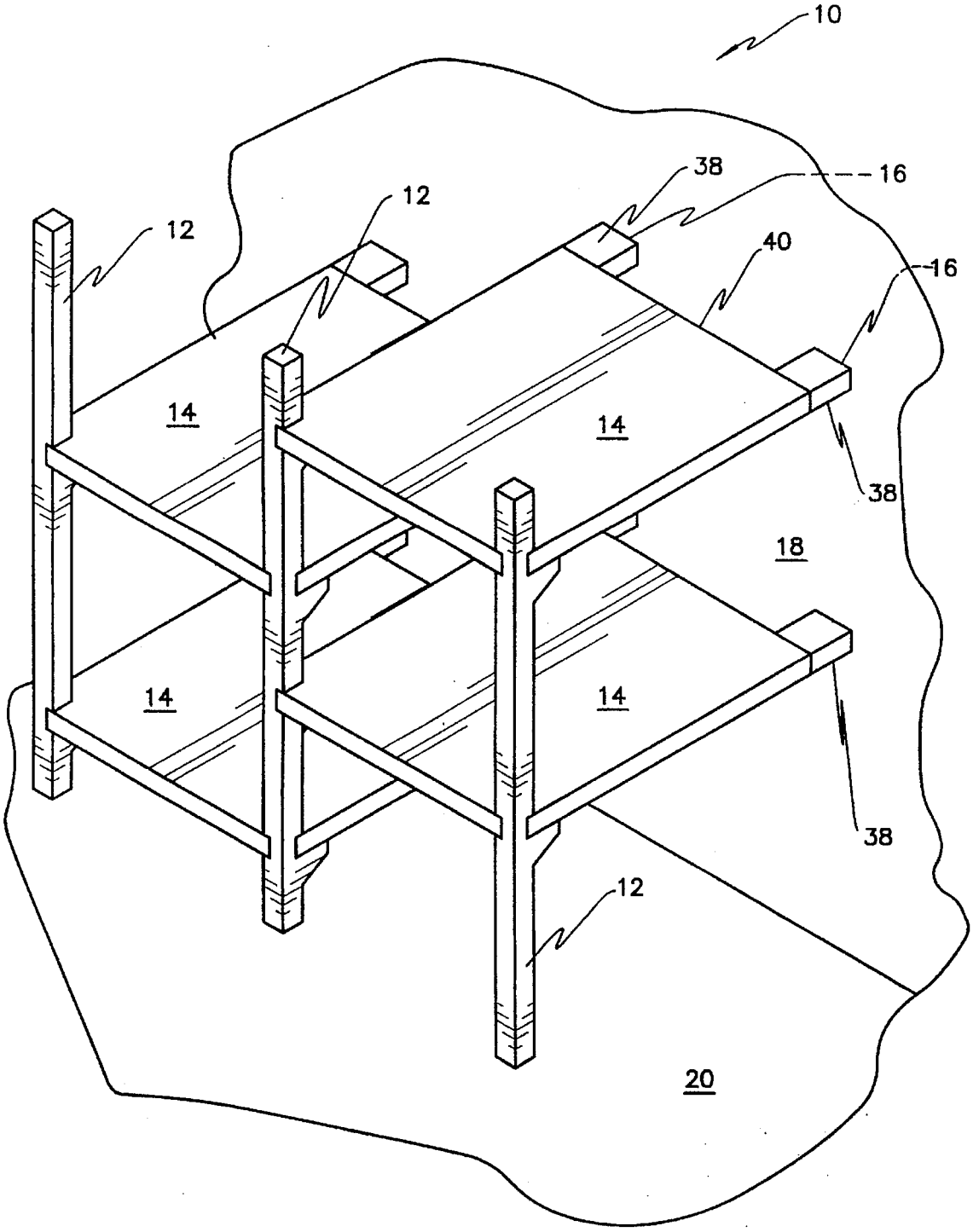
FIG. 1 is an environmental, perspective view of the invention.

Turning now to FIG. 1 of the drawings, the novel item of furniture 10 is shown assembled. Furniture 10 comprises three vertical legs 12, each adjacent pair of legs 12 spanned by two shelves 14. Shelves 14 are horizontal members connecting legs 12. At the rear of the shelves 14 is the shelf rear surface 40 and extending further rearwardly are tabs 38. It will be noted that legs 12 are located only on one side of furniture 10, and are the only components of furniture 10 touching the floor 20. For purposes of discussion, the side having legs 12 will be called the front of furniture 10. Left and right lateral sides and rear side designations will be called out in their normal relation to the front.

Shelves 14 are secured to legs 12 by grooved joints, there being such a Joint at every juncture of each shelf 14 with a leg 12. The grooved joints enable shelves 14 to be slid manually into engagement with legs 12, without the use of tools, fasteners, or other attachment hardware. The nature of the grooved joints and the characteristics of the assembled furniture 10 maintain furniture 10 upright and resistant to retraction of shelves 14 from legs 12.

Figure 2:
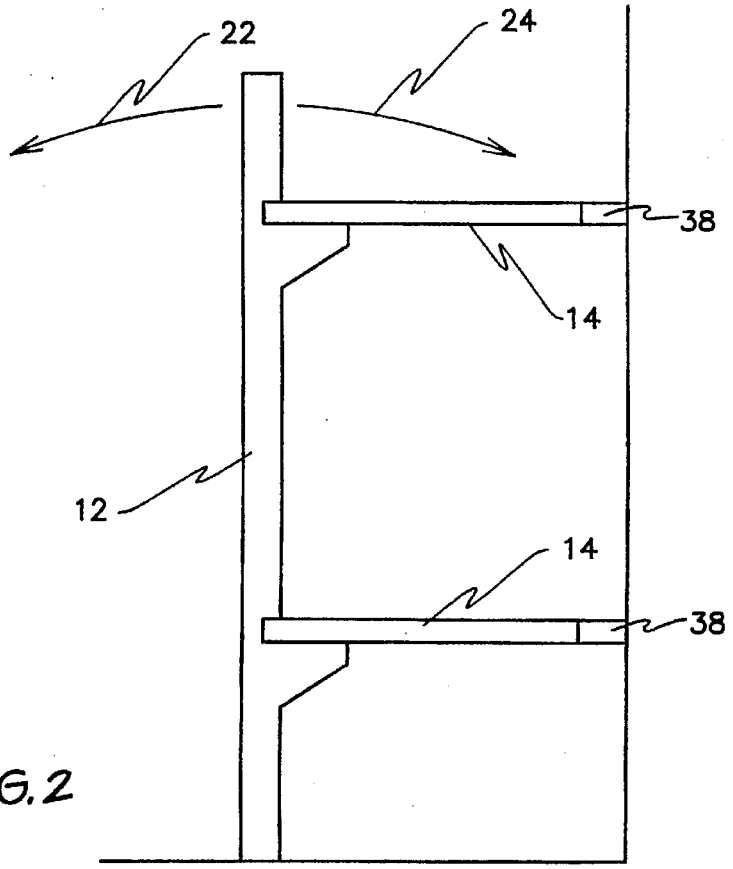
FIG. 2 is a side elevational view of the invention.

This is partially explained with reference to FIG. 2. The combined weight of the component parts and of any ordinary household objects (not shown) placed upon shelves 14 is borne by legs 12. The presence of two or more legs 12 (see FIG. 1) constrains furniture 10 from falling over or toppling in a right or left lateral direction. Toppling to the front, indicated by arrow 22, is prevented by the weight of shelves 14 to the rear of legs 12. Toppling to the rear is prevented, indicated by arrow 24, by abutment of shelves 14 with wall 18. Thus it can be seen that the assembled unit 10 will tilt freely (on the feet of legs 12) in a forward direction, as indicated by arrow 22, and is constrained by the wall 18, where it is engaged at 16.

Figure 3:
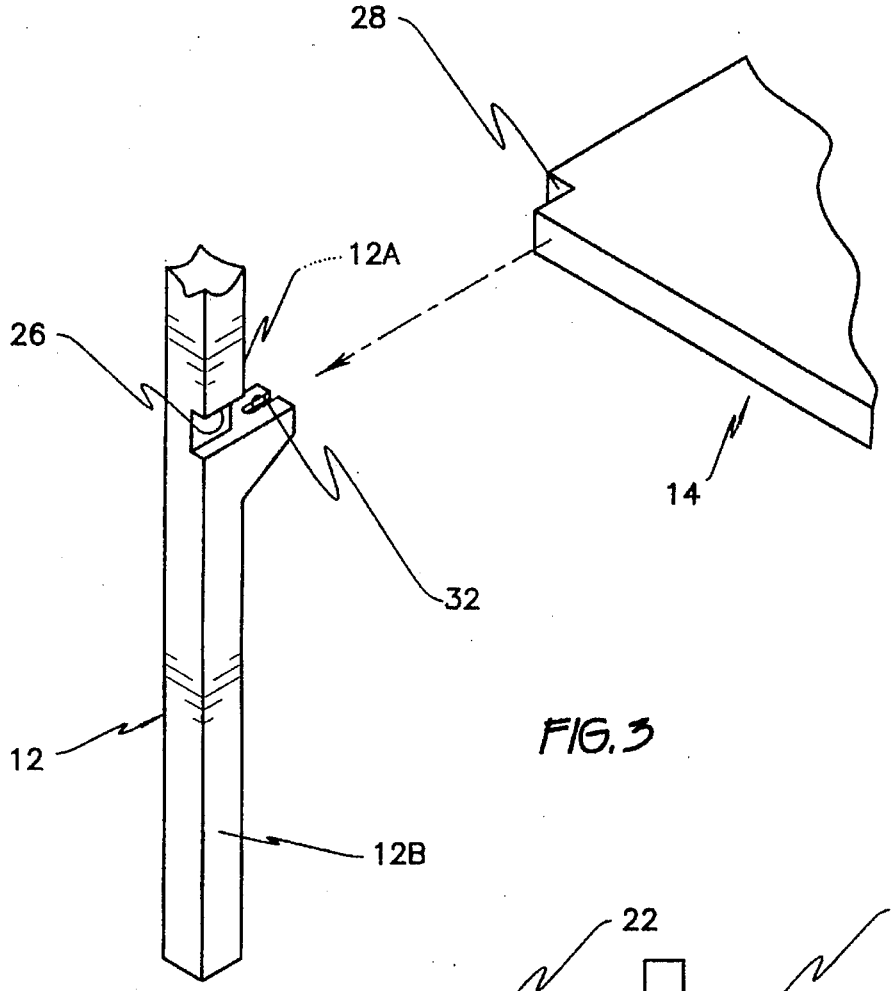
FIG. 3 is an enlarged, perspective detail view of the joint between a shelf and a leg.

Grooved joints are illustrated in FIG. 3. Each leg has a horizontal groove 26 which is formed in both the rear face 12A and either a right or left lateral face 12B of leg 12. Shelf 14 includes a notch 28 configured to cooperate with groove 26. Notch 28 enables a flush and cooperative fit between shelf 14 and leg 12, but a stop interfering with horizontal lateral movement is added to make mutual engagement more resistant to unintended displacement. The stop is provided by a knob 30 projecting downwardly from shelf 14, which knob 30 enters a smaller groove 32 formed in leg 12 during assembly.

Figure 4:
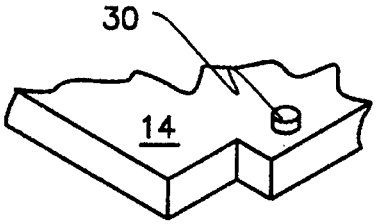
FIG. 4 is an enlarged perspective detail view of a knob projecting from the underside of a shelf, serving as a stop.
Figure 5:
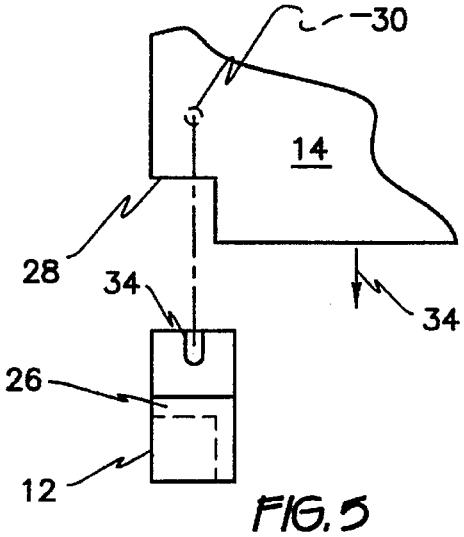
FIG. 5 is a top plan detail view of the components of FIG. 3, showing assembly of a shelf to a leg.

FIG. 4 shows knob 30, bearing in mind that in this view, shelf 14 is shown upside down. FIG. 5 shows alignment between shelf 14 with leg 12. Shelf 14 is moved in the direction indicated by arrow 34 for assembly. Thus, notch 28 mates with groove 26, and knob 30 cooperates with groove 32 when shelf 14 is slid into engagement with leg 12.

Figure 6:
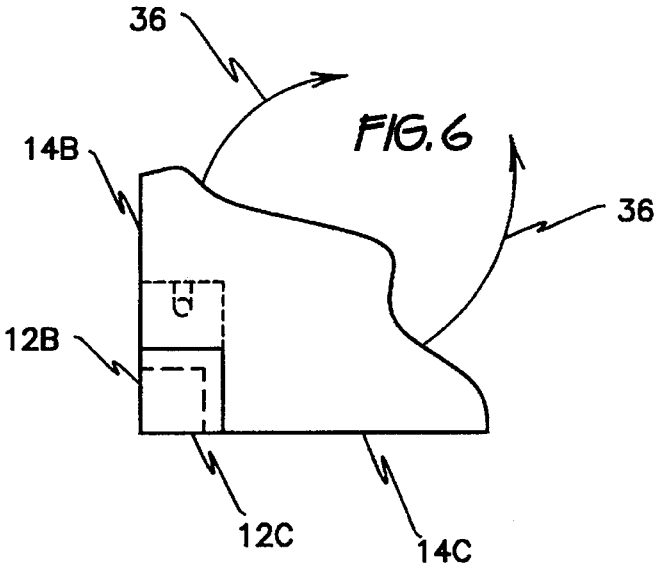
FIG. 6 is a top plan view of the components of FIG. 5, illustrating the fully assembled condition.

FIG. 6 shows that after assembly, left faces 12B, 14B (respectively) of leg 12 and shelf 14 are flush. This characteristic will be referred to hereinafter as being complementary, or providing a complementary fit. Also, front faces 12C, 14C (respectively) are flush. Moreover, a torque indicated by arrows 36, which could otherwise pull shelf 14 out of engagement with leg 12, is resisted by a close fit between knob 30 and groove 32. It will be noted that groove 32 opens rearwardly, so that both groove 32 and knob 30 are not visible from the front. The aesthetic impression formed by the complementary fit of leg and shelf is thus not marred by groove 32 and its associated knob 30.

Preferably, legs 12 will be provided with feet having structure or frictional qualities suited for conditions for preventing skidding or slipping. If furniture 10 is to be erected on carpet or rug (neither shown), then it would be desirable to have appropriately designed feet for engaging this type of surface. If erecting furniture on a smooth floor, then it would be desirable to provide feet having rubber or other high friction bottom surfaces.

It will be obvious to those of skill in the art that modifications and variations may be made on the furniture described herein. For example, any number of shelves or legs may be incorporated. Also, knob 30 may be located on a leg, with its associated groove 32 formed in a shelf.

Again referring to FIG. 1, tabs 38 project to the rear of each shelf 14. Tabs 38 bear rear surface 16 actually contacting an environmental surface. It would be possible to eliminate tabs 38 (see FIG. 1) bearing surface 16, in favor of employing the rear surface 40 of each shelf to contact wall 18, if desired.

Thus it will be seen that the novel furniture has minimal structure and complication, yet is quickly erected and dismantled. The novel furniture is stable when assembled and placed into its environment.

It is to be understood that the present invention is not limited to the embodiments described above, but encompasses any and all embodiments within the scope of the following claims.

I claim:

1. An item of furniture for placement in proximity to a wall comprising:

a front portion, a rear portion, and two sides;

at least two substantially vertical legs located proximate said front portion with at least one horizontal member having a rear edge removably attached therebetween; and where said rear portion of each said horizontal member includes a plurality of rearwardly disposed tabs extending beyond said rear edge, each of said tabs having thereon a further, rearwardly disposed vertically oriented wall engagement portion; whereby said item of furniture is placed such that said rearward facing vertically oriented wall engagement portions are in contact with, but not secured to, a wall and that said vertical legs are in contact with, but not secured to, the ground, and whereby said item of furniture is freely tiltable in a forward direction.

2. The item of furniture according to claim 1, wherein engagement means between said horizontal members and said legs occurs at every juncture therebetween, said engagement means comprising:

a horizontally oriented right angle notch in each said leg, said notch having a rearwardly facing portion, said rearward facing portion of said notch including an upwardly facing groove;

a right angle cut out portion in each said horizontal member, said cut out portion cooperating with said horizontally oriented right angle notch in each said leg, said engagement means further including a downwardly depending knob located proximate to and rearward of said cut out portion, said downwardly depending knob dimensioned and configured to cooperate with said upwardly facing groove; whereby angular and lateral motion between said horizontal members and said legs is prevented.

* * * * *